US010206542B2

(12) United States Patent
Minkovich et al.

(10) Patent No.: US 10,206,542 B2
(45) Date of Patent: Feb. 19, 2019

(54) GUIDE AND RAIL ASSEMBLY AND SYSTEM FOR SHOWER DOOR AND PANEL

(71) Applicant: Bath Authority LLC, Warminster, PA (US)

(72) Inventors: Michael Minkovich, Richboro, PA (US); Vadym Mironchuk, Southampton, PA (US)

(73) Assignee: BATH AUTHORITY LLC, Warminster, PA (US)

( * ) Notice: Subject to any disclaimer, the term of this patent is extended or adjusted under 35 U.S.C. 154(b) by 291 days.

(21) Appl. No.: 15/263,742

(22) Filed: Sep. 13, 2016

(65) Prior Publication Data

US 2018/0070779 A1 Mar. 15, 2018

(51) Int. Cl.
*E05D 13/00* (2006.01)
*A47K 3/34* (2006.01)
(Continued)

(52) U.S. Cl.
CPC ..... *A47K 3/34* (2013.01); *E05D 15/0669* (2013.01); *E05D 15/0691* (2013.01);
(Continued)

(58) Field of Classification Search
CPC ..... Y10T 16/361; Y10T 16/364; A47K 3/34; E05D 15/0691; E05D 15/0669;
(Continued)

(56) References Cited

U.S. PATENT DOCUMENTS 2,912,714 A * 11/1959 Rich ..... E05D 15/0669 16/100
3,750,737 A * 8/1973 Woodward ..... A47K 3/34 160/202

(Continued)

OTHER PUBLICATIONS

Mirage Sliding Bracket Assembly, Dreamline, catalog cut sheet ad installation guide posted at http://www.bathauthority.com/, publication date Sep. 2015, © Dreamline, [online], site visited Jul. 18, 2017. Available at URL: http://www.bathauthority.com/pdf_files/manuals/MIRAGE_MANUAL.PDF (15 pages).

(Continued)

*Primary Examiner* — Jerry E Redman
(74) *Attorney, Agent, or Firm* — Fox Rothschild, LLP

(57) ABSTRACT

A guide and rail assembly and system for stabilizing a shower door and stationary panel of a shower enclosure are disclosed. The assembly includes an exterior slider bracket configured for mounting on top edge of stationary panel, an exterior slider guide block configured for mounting on top edge of shower door, and an interior slider bracket configured to be housed within a longitudinal channel of the exterior slider guide block such that exterior slider guide block sets atop interior slider bracket and is secured thereto. The assembly further includes a front housing plate configured for attaching to bottom edge of the shower door, a roller bearing component configured to be slidably disposed along top surface of bottom guard rail of shower enclosure, a rear housing plate, and a cover plate configured to be secured to the rear housing plate. Cover plate and rear housing plate are (Continued)

positioned opposite of bottom edge of shower door from front housing plate such that roller bearing component is slidably disposed therebetween front housing plate and rear housing plate in an assembled configuration.

19 Claims, 7 Drawing Sheets

(51) Int. Cl.
*E05D 15/06* (2006.01)
*E06B 3/46* (2006.01)

(52) U.S. Cl.
CPC ..... *E06B 3/4681* (2013.01); *E05Y 2201/614* (2013.01); *E05Y 2800/672* (2013.01); *E05Y 2900/114* (2013.01)

(58) Field of Classification Search
CPC ..... E06B 3/4681; E05Y 2800/672; E05Y 2201/614; E05Y 2900/114
USPC ..... 49/425, 410, 411; 4/614
See application file for complete search history.

(56) References Cited

U.S. PATENT DOCUMENTS 4,178,718 A 12/1979 Laby
4,392,272 A 7/1983 Finkel
D275,247 S 8/1984 Sherman
D285,286 S 8/1986 Sharpe
D288,661 S 3/1987 Sharpe
4,811,683 A * 3/1989 Gephart ..... E05D 15/066 16/100
4,937,979 A * 7/1990 Liou ..... E05B 67/36 49/404
5,148,630 A * 9/1992 Llorens ..... E05D 15/066 16/100
D380,953 S 7/1997 Norgaard
D410,835 S 6/1999 Cosgrove
5,934,719 A 8/1999 Athanasios
D504,609 S 5/2005 Ferguson
D547,637 S 7/2007 Blacker
D555,468 S 11/2007 Caswell et al.
D556,558 S 12/2007 Biancardi et al.
7,513,080 B1 4/2009 Showalter
7,549,253 B2 6/2009 Hockman
7,637,058 B2 12/2009 Lai
D614,483 S 4/2010 Leibe, III
D615,847 S 5/2010 Tezak et al.
D616,276 S 5/2010 Friegang
7,712,258 B2 5/2010 Ewing et al.
D622,131 S 8/2010 Tezak et al.
7,931,159 B2 4/2011 Kao
D651,503 S 1/2012 Ellis
D654,347 S 2/2012 Chen
D662,805 S 7/2012 Macdonald et al.
8,528,888 B2 9/2013 Header
D702,523 S 4/2014 Ingram
8,850,659 B2 10/2014 Ewing
8,910,928 B2 12/2014 Header
D727,716 S 4/2015 Langle
D735,017 S 7/2015 Langle
D735,023 S 7/2015 Baldwin et al.
D737,670 S 9/2015 Beyerle et al.
9,127,491 B2 9/2015 Bouthillier
D742,969 S 11/2015 White
D747,225 S 1/2016 Decook et al.
D756,211 S 5/2016 Downs
9,353,527 B2 5/2016 Smeja
9,364,121 B2 * 6/2016 Sprague ..... E05D 15/0686
9,382,737 B2 7/2016 Wei
D777,024 S 1/2017 Lee et al.
D779,713 S 2/2017 Sonneman
D779,714 S 2/2017 Sonneman
D781,681 S 3/2017 Nagaki et al.
9,714,670 B2 7/2017 Header
9,745,787 B2 8/2017 Conley et al.
9,752,379 B2 9/2017 Aykas
9,839,330 B2 * 12/2017 Aykens ..... A47K 3/34
2002/0157318 A1 10/2002 Teubert et al.
2003/0019030 A1 1/2003 Kopacz et al.
2005/0102958 A1 5/2005 Anderson
2010/0058701 A1 3/2010 Yao et al.
2010/0083588 A1 4/2010 Hockman
2011/0214367 A1 9/2011 Haddock et al.
2013/0097935 A1 * 4/2013 Sprague ..... E05D 15/0686 49/425
2014/0115773 A1 5/2014 Wei
2014/0143980 A1 5/2014 Chang et al.
2015/0252603 A1 9/2015 Cianetti
2016/0138311 A1 5/2016 Kreyenborg
2016/0166120 A1 6/2016 Ball et al.
2016/0206157 A1 7/2016 Ball et al.
2016/0258198 A1 9/2016 Bouthillier
2016/0369547 A1 12/2016 Sato
2018/0030747 A1 2/2018 Ferris
2018/0070779 A1 * 3/2018 Minkovich ..... A47K 3/34
2018/0148965 A1 5/2018 Lam

OTHER PUBLICATIONS

Information about Related Patents and Patent Applications, see section 6 of the accompanying Information Disclosure Statement Letter, which concerns Related Patents and Patent Applications.

* cited by examiner

GUIDE AND RAIL ASSEMBLY AND SYSTEM FOR SHOWER DOOR AND PANEL

TECHNICAL FIELD

The present invention relates to the field of bathroom hardware, and more particularly, to a guide and rail assembly and system for a shower door and stationary panel, for example, a glass door and a glass stationary panel of a shower enclosure.

BACKGROUND

For many years, the most commonly used enclosure for a tub/shower bathing facility has included a pair of sliding glass doors framed in metal. In a typical installation, an outer metal frame circumscribes the entry to the bath and is attached at the sides to the walls of the facility. The installation also includes a header spanning the entrance and a guide rail attached to the tub or shower base. The shower doors are hung at the top from the header and guided at the bottom by the rail so that they can slide back and forth in the entryway to allow entry and egress and to create a splash barrier.

There are several disadvantages with the described installation, both functional and aesthetic. First, the support structure is always present in the entryway to the bathing area, thus always at least partially blocking the entrance and restricting free access to the bathing area, a special problem when bathing a small child or when cleaning the facility. The header also adds an undesired obstruction in the entryway which must be avoided when entering or leaving the area. Moreover, the metal of the frame and all the glass-to-metal interfaces require special cleaning and maintenance. Apart from these functional constraints, the metal required for the framing, header and rail detracts from a clean and open appearance of the facility.

Various systems eliminating the shower door header have been utilized, including enclosure systems with the shower door hingedly or slidably connected to a glass panel, which is in turn mounted to an adjacent wall. Conventional enclosure systems are disadvantageous in that they use more hardware material than is desired and are hence heavier or obtrusive in appearance. In addition, conventional enclosure systems include many individual parts to assemble and install. Further, conventional enclosure systems are prone to trap moisture within the track and make it difficult to adjust the glass height and angle and install the door securely onto the track.

It would thus be desirable to have a guide and rail assembly and system for stabilizing a shower door and stationary panel, among other desirable features as described herein, while avoiding the disadvantages of the known conventional enclosure systems.

SUMMARY

In a first aspect, there is provided herein a guide and rail assembly for stabilizing a shower door and stationary panel of a shower enclosure. The assembly includes: an exterior slider bracket having a body configured for mounting on a top edge of the stationary panel and an inner side defining at least two holes for receiving a pair of guide pins therethrough; an exterior slider guide block having a body defining a longitudinal channel therethrough and configured for mounting on a top edge of the shower door, the exterior slider guide block defining at least two fastening screw receiving holes on a top side thereof and at least two holes on a front side for receiving a distal end of the pair of guide pins therethrough; and an interior slider bracket having a body configured for mounting on the top edge of the shower door and defining at least two fastening screw receiving holes on a top side thereof. The interior slider bracket is configured to be housed within the longitudinal channel of the exterior slider guide block such that the exterior slider guide block sets atop the interior slider bracket and is secured thereto. The distal end of the pair of guide pins abut a front side of the interior slider bracket when extended therethrough the front side of the exterior slider guide block in an assembled configuration.

The assembly further includes: a front housing plate having an inner side and configured for attaching to a bottom edge of the shower door; a roller bearing component having a first side and a second side and a center opening therethrough and configured to be slidably disposed along a top surface of a bottom guard rail of the shower enclosure, wherein the inner side of the front housing plate is configured to receive the first side of the roller bearing component in a defined surface on the inner side of the front housing plate; a rear housing plate having a body defining a center opening therethrough and at least two receiving holes therethrough and configured for attaching to the bottom edge of the shower door, the rear housing plate having a defined inner surface configured to receive the second side of the roller bearing component; and a cover plate having a body defining at least two receiving holes therethrough, wherein an inner surface of the cover plate is configured to be secured to the rear housing plate. The cover plate and the rear housing plate are positioned on an opposite side of the bottom edge of the shower door from the front housing plate such that the roller bearing component is slidably disposed therebetween the front housing plate and the rear housing plate when in the assembled configuration.

In certain embodiments, the body of the exterior slider bracket is L-shaped.

In certain embodiments, the top edge of the stationary panel is notched such that the pair of guide pins extends therethrough when secured on the inner side of the exterior slider bracket.

In certain embodiments, the exterior slider bracket is mounted to the top edge of the stationary panel with at least one gasket having at least two holes therethrough and the pair of guide pins such that the distal end of the pair of guide pins are encased by a pair of rubber sleeves and extend therethrough the at least one gasket.

In certain embodiments, the body of the exterior slider guide block is U-shaped.

In certain embodiments, the exterior slider guide block is mounted on the top edge of the shower door via a first screw and a second screw extended therethrough the at least two fastening screw receiving holes on the top side of the exterior slider guide block with the interior slider bracket housed therebetween the longitudinal channel.

In certain embodiments, the exterior slider guide block is secured to the exterior slider bracket via the pair of guide pins by at least two set screws extended therethrough at least two set screw receiving holes on an edge of the top side of the exterior slider guide block.

In certain embodiments, the exterior slider guide block is secured to the interior slider bracket housed therebetween the longitudinal channel via at least two screws extended therethrough the at least two fastening screw receiving holes on the top side of the exterior slider guide block and the top side of the interior slider bracket.

In certain embodiments, the bottom edge of the shower door is notched such that the roller bearing component is installed onto the shower door.

In certain embodiments, the defined surface on the inner side of the front housing plate is semi-circular such that the first side of the roller bearing component is configured to be secured thereto with at least one rubber pad disposed therebetween.

In certain embodiments, the assembly further includes at least one circular shaft component having an opening therethrough such that the front housing plate is secured to the bottom edge of the shower door via at least one bolt extended through the center opening of the rear housing plate, the opening of the at least one circular shaft component, and the center opening of the roller bearing component in the assembled configuration.

In certain embodiments, the rear housing plate is secured to the bottom edge of the shower door via at least three bolts extended through the at least two receiving holes of the rear housing plate.

In certain embodiments, the cover plate is secured to the rear housing plate via at least two bolts extended through the at least two receiving holes of the cover plate.

In certain embodiments, the defined inner surface of the rear housing plate is semi-circular such that the second side of the roller bearing component is configured to be secured thereto with at least one rubber pad disposed therebetween.

In certain embodiments, the roller bearing component is circular.

In a second aspect, there is provided herein a guide and rail system for stabilizing a shower door and stationary panel of a shower enclosure. The system includes a guide and rail assembly as previously described herein, wherein the exterior slider bracket, the exterior slider guide block, and the interior slider bracket are configured to be installed on the top edge of the stationary panel and the top edge of the shower door, and the front housing plate, the roller bearing component, rear housing plate, and cover plate are configured to be installed on the bottom edge of the shower door in a first area and a second area.

In certain embodiments, the first area is on a left side of the shower door and the second area is on a right side of the shower door.

In certain embodiments, the bottom guard rail of the shower enclosure includes a longitudinal track configured to be pre-drilled to allow moisture to flow therefrom and air to circulate within the guard rail.

Various advantages of this disclosure will become apparent to those skilled in the art from the following detailed description, when read in light of the accompanying drawings.

DETAILED DESCRIPTION

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the present disclosure is not limited to the pivot hinge assembly having the specific sizes or dimensions recited herein. As used herein, the term "comprising" means "including, but not limited to."

In consideration of the figures, it is to be understood for purposes of clarity certain details of construction and/or operation are not provided in view of such details being conventional and well within the skill of the art upon disclosure of the document described herein. In the figures, like numerals indicate like elements throughout.

The present disclosure pertains to a guide and rail assembly and system for stabilizing a glass shower door and a glass stationary panel of a shower enclosure. The guide and rail assembly and system achieve a more frameless appearance of the shower enclosure, include a roller track that is easier to clean and is lower to the supporting floor or threshold to reduce obstruction in shower area, and provide a smoother open and close operation.

In addition to the advantages described above, the guide and rail assembly and system provide easier access to the roller bearing component to clean or replace, provide increased stability of the stationary panel without any additional support, allow easy adjustment of the glass door and panel height and angle, operate on a low profile roller track, prevent moisture accumulation and mildew inside the roller track, provide easier installment of the shower door onto the track, consist of smaller parts which improve the appearance of the shower enclosure, among other desirable features as described herein.

Figure 1:
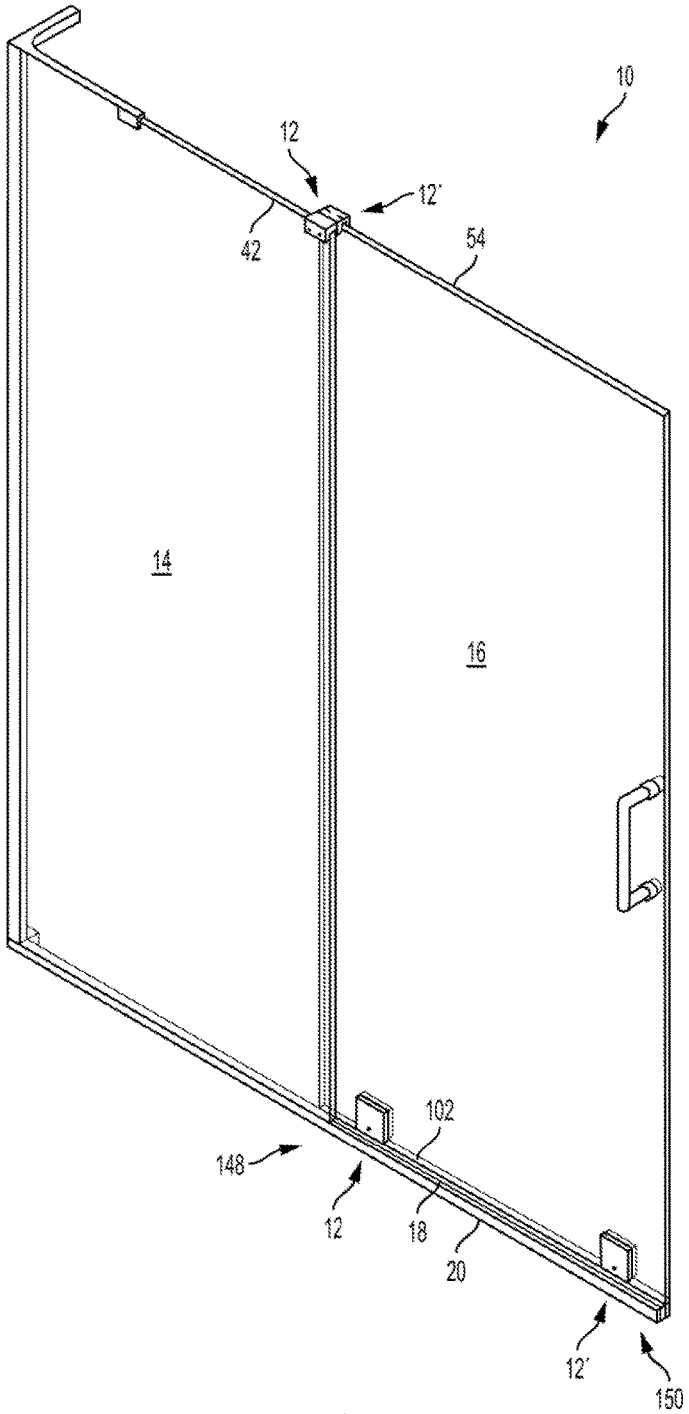
FIG. 1 is a perspective view of an exemplary shower enclosure incorporating a guide and rail assembly and system in accordance with an embodiment of the present disclosure.

Referring now to FIG. 1 is a perspective view of an exemplary shower enclosure 10 incorporating a guide and rail assembly 12 in accordance with an embodiment of the present disclosure. The shower enclosure 10 includes a glass stationary panel 14 and a shower door 16. The shower door 16 is connected to the glass stationary panel 14 by the guide and rail assembly 12 and is opened and closed by sliding along a top surface 18 of a bottom guide rail 20 of the shower enclosure 10. Such a configuration maintains a clean aesthetic appearance for the shower enclosure 10. It should be understood that the guide and rail assembly 12 is not limited to the shower enclosure 10 illustrated in FIG. 1. The illustrated shower enclosure in FIG. 1 is for illustration only as the guide and rail assembly 12 and system 12' may be utilized to stabilize a glass panel and shower door in various shower enclosure configurations.

Referring to FIGS. 2-17, the guide and rail assembly 12 will be described in more detail. The guide and rail assembly 12 generally includes an exterior slider bracket 22, an exterior slider guide block 24, an interior slider bracket 26, a front housing plate 28, a roller bearing component 30, a rear housing plate 32 and a cover plate 34. The exterior slider bracket 22, exterior slider guide block 24, and interior slider bracket 26 form the guide assembly 36 (FIG. 2) of guide and rail assembly 12 while the remaining components, namely, the front housing plate 28, roller bearing component 30, rear housing plate 32 and cover plate 34 form the rail assembly 38 (FIG. 7) of the guide and rail assembly 12.

FIGS. 2-6 and 16 show various views of the guide assembly 36 of the guide and rail assembly 12. Specifically, the exterior slider bracket 22 includes a body 40 configured for mounting on a top edge 42 of the glass stationary panel 14 and an inner side 44 defining at least two holes 46 for receiving a pair of guide pins 48 therethrough. The exterior slider guide block 24 includes a body 50 defining a longitudinal channel 52 therethrough. The exterior slider guide block 24 is configured for mounting on a top edge 54 of the shower door 16. The exterior slider guide block 24 defines at least two fastening screw receiving holes 56 on a top side 58 thereof and at least two holes 60 on a front side 62 for receiving a distal end 64 of the pair of guide pins 48 therethrough. The interior slider bracket 26 includes a body 66 configured for mounting on the top edge 54 of the shower door 16. The interior slider bracket 26 defines at least two fastening screw receiving holes 68 on a top side 70 thereof. The interior slider bracket 26 is configured to be housed within the longitudinal channel 52 of the exterior slider guide block 24 such that the exterior slider guide block sets atop the interior slider bracket and is secured thereto. The distal end 64 of the pair of guide pins 48 abut a front side 72 of the interior slider bracket 26 when extended therethrough the front side 62 of the exterior slider guide block 24 in an assembled configuration.

In some embodiments, the body 40 of the exterior slider bracket 22 is L-shaped 74. In further embodiments, the body 50 of the exterior slider guide block 24 is U-shaped 76. It should be understood that the guide and rail assembly 12 and components thereof can be fabricated in different shapes as long as the desired shape does not affect the bracket/glass contact area and the support points of the glass panel and glass door.

Figure 2:
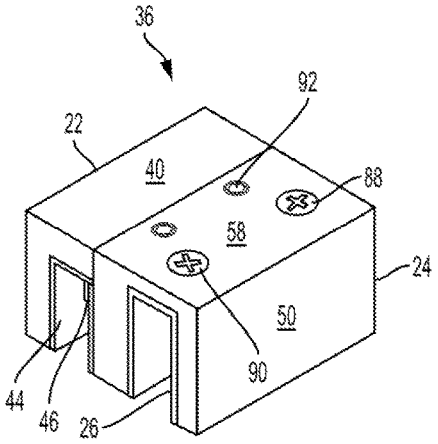
FIG. 2 is an enlarged perspective view of the guide assembly for a stationary glass panel of the exemplary shower enclosure of FIG. 1.
Figure 3:
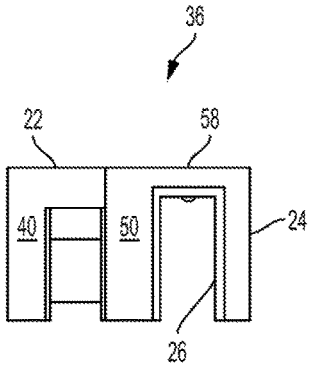
FIG. 3 is a side elevational view of the guide assembly of FIG. 2.
Figure 4:
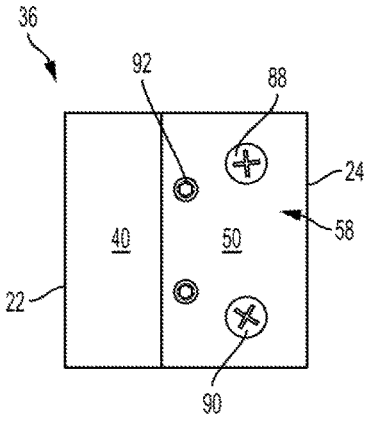
FIG. 4 is a top plan view of the guide assembly of FIG. 2.
Figure 5:
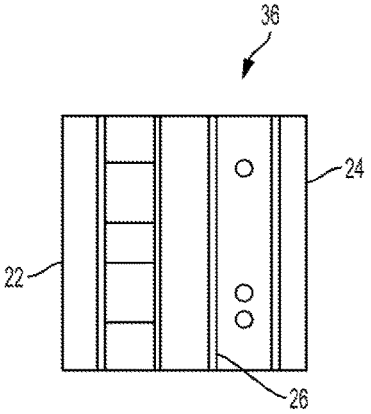
FIG. 5 is a bottom plan view of the guide assembly of FIG. 2.
Figure 6:
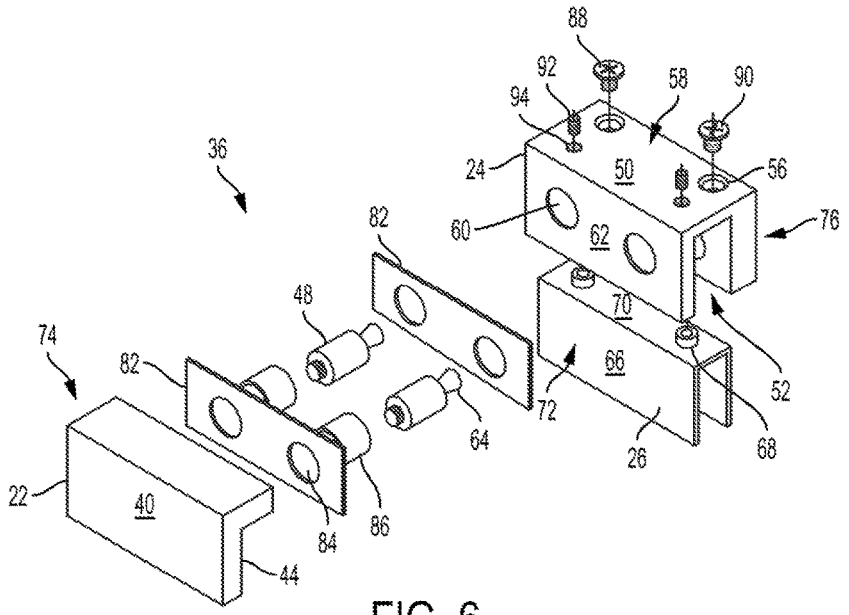
FIG. 6 is an enlarged exploded perspective view of the guide assembly of FIG. 2.
Figure 16A:
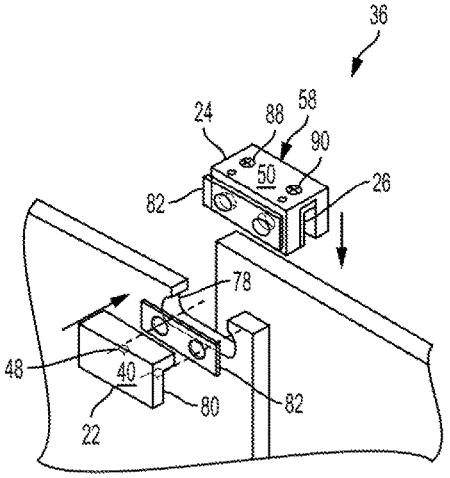
FIGS. 16A-16B are up close top perspective views of the guide assembly of FIG. 2 shown being installed on a top edge of the stationary glass panel and glass door of the exemplary shower enclosure of FIG. 1.
Figure 16B:
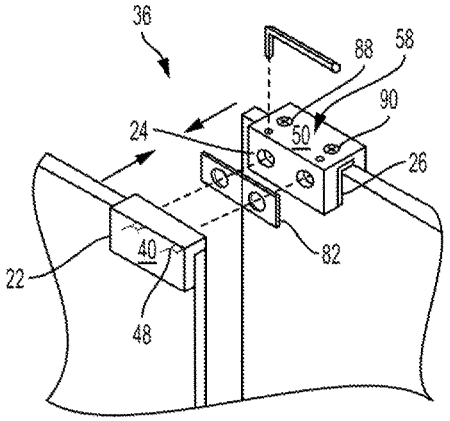

FIGS. 16A-16B are up close top perspective views of the guide assembly of FIG. 2 shown being installed on a top edge of the stationary glass panel and glass door of the exemplary shower enclosure of FIG. 1. In the illustrated embodiments, the top edge 42 of the stationary panel 14 is notched 78 (FIG. 16A) such that the pair of guide pins 48 extends therethrough when secured on the inner side 80 of the exterior slider bracket 22.

In some embodiments, the exterior slider bracket 22 is mounted to the top edge 42 of the stationary panel 14 with at least one gasket 82 having at least two holes 84 therethrough and the pair of guide pins 48 such that the distal end 64 of the pair of guide pins are encased by a pair of rubber sleeves 86 and extend therethrough the at least one gasket 82.

In the illustrated embodiments, the exterior slider guide block 24 is mounted on the top edge 54 of the shower door 16 via a first screw 88 and a second screw 90 extended therethrough the at least two fastening screw receiving holes 56 on the top side 58 of the exterior slider guide block 24 with the interior slider bracket 26 housed therebetween the longitudinal channel 52.

In some embodiments, the exterior slider guide block 24 is secured to the exterior slider bracket 22 via the pair of guide pins 48 by at least two set screws 92 extended therethrough at least two set screw receiving holes 94 on an edge 96 of the top side 58 of the exterior slider guide block 24. Tightening of the at least two set screws 92 secures the exterior slider guide block 24 to the exterior slider bracket 22 of the guide assembly 36 of the guide and rail assembly 12.

In further embodiments, the exterior slider guide block 24 is secured to the interior slider bracket 26 housed therebetween the longitudinal channel 52 via at least two screws 88, 90 extended therethrough the at least two fastening screw receiving holes 56 on the top side 58 of the exterior slider guide block 24 and the top side 70 of the interior slider bracket 26. Tightening of the at least two screws 88, 90 secures the exterior slider guide block 24 to the interior slider bracket 26 of the guide assembly 36 of the guide and rail assembly 12.

FIGS. 7-15 and 17 show various views of the rail assembly 38 of the guide and rail assembly 12. Specifically, the front housing plate 28 includes an inner side 100 configured for attaching to a bottom edge 102 of the shower door 16. The roller bearing component 30 includes a first side 104 and a second side 106 and a center opening 108 therethrough. The roller bearing component 30 is configured to be slidably disposed along the top surface 18 of the bottom guard rail 20 of the shower enclosure 10. The inner side 100 of the front housing plate 28 is configured to receive the first side 104 of the roller bearing component 30 in a defined surface 110 on the inner side 100 of the front housing plate 28. The rear housing plate 32 includes a body 112 defining a center opening 114 therethrough and at least two receiving holes 116 therethrough. The rear housing plate 32 is configured for attaching to the bottom edge 102 of the shower door 16. The rear housing plate 32 includes a defined inner surface 118 configured to receive the second side 106 of the roller bearing component 30. The cover plate 34 includes a body 120 defining at least two receiving holes 122 therethrough such that an inner surface 124 of the cover plate 34 is configured to be secured to the rear housing plate 32. The cover plate 34 and the rear housing plate 32 are positioned on an opposite side 126 of the bottom edge 102 of the shower door 16 from the front housing plate 28 such that the roller bearing component 30 is slidably disposed therebetween the front housing plate 28 and the rear housing plate 32 when in the assembled configuration.

Figure 7:
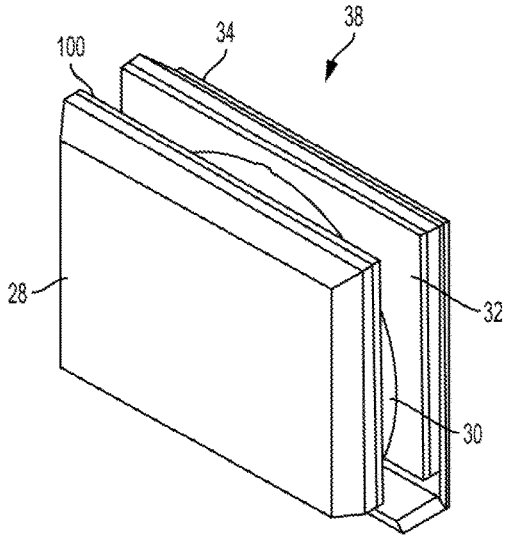
FIG. 7 is an enlarged perspective view of the rail assembly for a glass door of the exemplary shower enclosure of FIG. 1.
Figure 8:
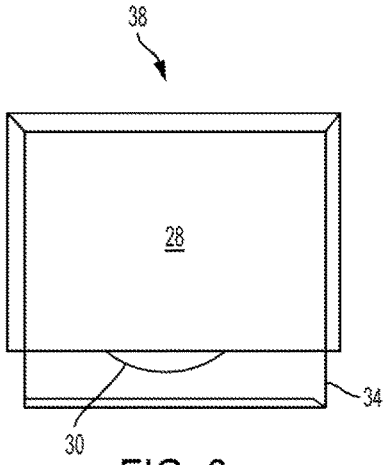
FIG. 8 is a front plan view of the rail assembly of FIG. 7
Figure 9:
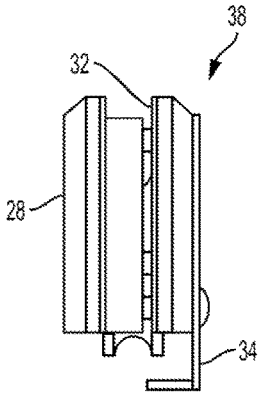
FIG. 9 is a side elevational view of the rail assembly of FIG. 7.
Figure 10:
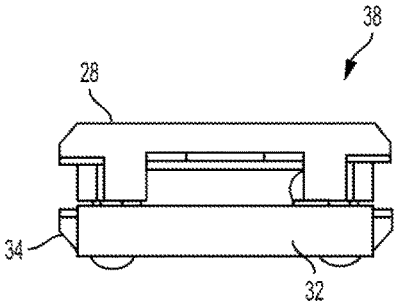
FIG. 10 is a bottom plan view of the rail assembly of FIG. 7.
Figure 11:
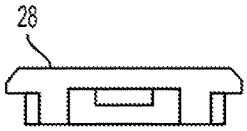
FIG. 11 is a top plan view of the front housing plate of the rail assembly of FIG. 7.
Figure 12:
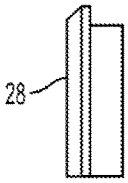
FIG. 12 is a side elevational view of the front housing plate of the rail assembly of FIG. 7.
Figure 13:
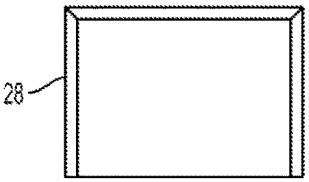
FIG. 13 is a front plan view of the front housing plate of the rail assembly of FIG. 7.
Figure 14:
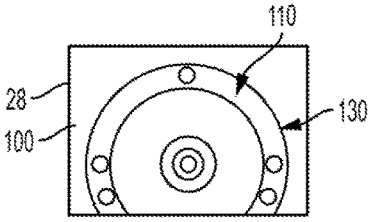
FIG. 14 is a rear plan view of the front housing plate of the rail assembly of FIG. 7.
Figure 15:
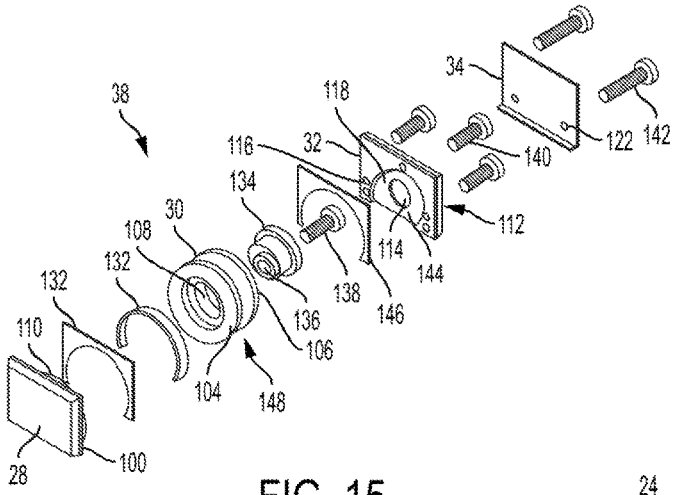
FIG. 15 is an enlarged exploded perspective view of the rail assembly of FIG. 7.
Figure 17A:
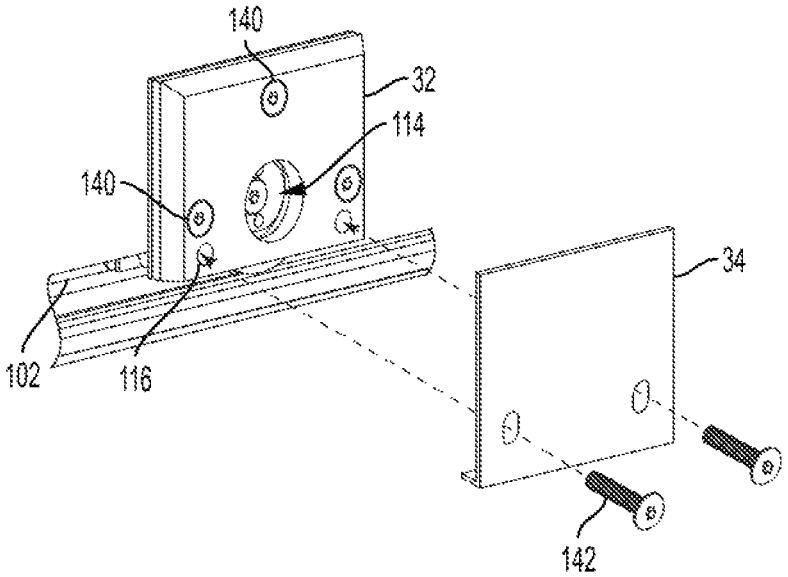
FIGS. 17A-17B are up close perspective and cross-sectional views of the rail assembly of FIG. 7 shown being installed from the inside of a bottom edge of the glass door of the exemplary shower enclosure of FIG. 1.
Figure 17B:
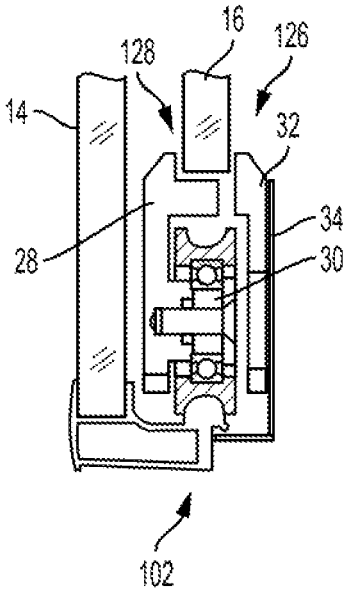

FIGS. 17A-17B are up close perspective and cross-sectional views of the rail assembly of FIG. 7 shown being installed from the inside of a bottom edge of the glass door of the exemplary shower enclosure of FIG. 1. In the illustrated embodiments, the bottom edge 102 of the shower door 16 is notched 128 (FIG. 17B) such that the roller bearing component 30 is installed onto the shower door 16.

In some embodiments, the defined surface 110 on the inner side 100 of the front housing plate 28 is semi-circular 130 (FIG. 14) such that the first side 104 of the roller bearing component 30 is configured to be secured thereto with at least one rubber pad 132 disposed therebetween.

In the illustrated embodiments, the rail assembly 38 of the guide and rail assembly 12 further includes at least one circular shaft component 134 having an opening 136 therethrough such that the front housing plate 28 is secured to the bottom edge 102 of the shower door 16 via at least one bolt 138 extended through the center opening 114 of the rear housing plate 32, the opening 136 of the at least one circular shaft component 134, and the center opening 108 of the roller bearing component 30 in the assembled configuration. The shaft component 134 features an eccentric hole 136 that allows for vertical adjustment of bearing component 30.

In some embodiments, the rear housing plate 32 is secured to the bottom edge 102 of the shower door 16 via at least three bolts 140 extended through the at least two receiving holes 116 of the rear housing plate 32.

In some embodiments, the cover plate 34 is secured to the rear housing plate 32 via at least two bolts 142 extended through the at least two receiving holes 122 of the cover plate 34.

In the illustrated embodiments, the defined inner surface 118 of the rear housing plate 32 is semi-circular 144 (FIG. 15) such that the second side 106 of the roller bearing component 30 is configured to be secured thereto with at least one rubber pad 146 disposed therebetween.

In further embodiments, the roller bearing component 30 is circular 148. It should be understood that the guide and rail assembly 12 and the components thereof can be fabricated of different shapes as described above.

It should be understood that the guide and rail assembly 12 can be fabricated of plastic and/or other suitable sturdy materials, such as stainless steel, metal alloys and the like. Similarly, it should be understood that the guide and rail assembly 12 can be fabricated in different finishes, such as polished, brushed and the like.

It should be further understood that the guide and rail assembly 12 and various components thereof, such as the roller bearing component 30, can be fabricated in different sizes and are sized to scale the particular shower enclosure selected to be installed in the bathroom space.

In accordance with the present disclosure, there is further disclosed a guide and rail system 12' for stabilizing a shower door 16 and stationary panel 14 of a shower enclosure 10. The guide and rail system 12' includes the guide and rail assembly 12 as described in detail above, wherein the exterior slider bracket 22, the exterior slider guide block 24, and the interior slider bracket 26 are configured to be installed on the top edge 42 of the stationary panel 14 and the top edge 54 of the shower door 16, and the front housing plate 28, the roller bearing component 30, rear housing plate 32, and cover plate 34 are configured to be installed on the bottom edge 102 of the shower door 16 in a first area 148 and a second area 150.

In the illustrated embodiments, the first area 148 is on a left side of the shower door 16 and the second area 150 is on a right side of the shower door 16.

In some embodiments, the bottom guard rail 20 of the shower enclosure 10 includes a longitudinal track 152 configured to be pre-drilled to allow moisture to flow therefrom and air to circulate within the guard rail 20. It should be understood that the bottom guard rail is preferably low profile such that it is lower to the supporting floor or threshold to reduce obstruction in the shower area and promote the frameless appearance of the shower enclosure.

These and other advantages of the present disclosure will be apparent to those skilled in the art. Accordingly, it will be recognized by those skilled in the art that changes or modifications may be made to the above described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the following claims.

What is claimed is:

1. A guide and rail assembly for stabilizing a shower door and stationary panel of a shower enclosure, the assembly comprising:

an exterior slider bracket having a body configured for mounting on a top edge of the stationary panel, the exterior slider bracket having an inner side defining at least two holes for receiving a pair of guide pins therethrough;

an exterior slider guide block having a body defining a longitudinal channel therethrough and configured for mounting on a top edge of the shower door, the exterior slider guide block defining at least two fastening screw receiving holes on a top side thereof and at least two holes on a front side for receiving a distal end of the pair of guide pins therethrough;

an interior slider bracket having a body configured for mounting on the top edge of the shower door, the interior slider bracket defining at least two fastening screw receiving holes on a top side thereof, wherein the interior slider bracket is configured to be housed within the longitudinal channel of the exterior slider guide block such that the exterior slider guide block sets atop the interior slider bracket and is secured thereto, wherein the distal end of the pair of guide pins abut a front side of the interior slider bracket when extended therethrough the front side of the exterior slider guide block in an assembled configuration;

a front housing plate having an inner side and configured for attaching to a bottom edge of the shower door;

a roller bearing component having a first side and a second side and a center opening therethrough and configured to be slidably disposed along a top surface of a bottom guard rail of the shower enclosure, wherein the inner side of the front housing plate is configured to receive the first side of the roller bearing component in a defined surface on the inner side of the front housing plate;

a rear housing plate having a body defining a center opening therethrough and at least two receiving holes therethrough and configured for attaching to the bottom edge of the shower door, the rear housing plate having a defined inner surface configured to receive the second side of the roller bearing component;

a cover plate having a body defining at least two receiving holes therethrough, wherein an inner surface of the cover plate is configured to be secured to the rear housing plate;

wherein the cover plate and the rear housing plate are positioned on an opposite side of the bottom edge of the shower door from the front housing plate such that the roller bearing component is slidably disposed therebetween the front housing plate and the rear housing plate when in the assembled configuration.

2. The assembly of claim 1, wherein the body of the exterior slider bracket is L-shaped.

3. The assembly of claim 1, wherein the top edge of the stationary panel is notched such that the pair of guide pins extends therethrough when secured on the inner side of the exterior slider bracket.

4. The assembly of claim 1, wherein the exterior slider bracket is mounted to the top edge of the stationary panel with at least one gasket having at least two holes therethrough and the pair of guide pins such that the distal end of the pair of guide pins are encased by a pair of rubber sleeves and extend therethrough the at least one gasket.

5. The assembly of claim 1, wherein the body of the exterior slider guide block is U-shaped.

6. The assembly of claim 1, wherein the exterior slider guide block is mounted on the top edge of the shower door via a first screw and a second screw extended therethrough the at least two fastening screw receiving holes on the top side of the exterior slider guide block with the interior slider bracket housed therebetween the longitudinal channel.

7. The assembly of claim 1, wherein the exterior slider guide block is secured to the exterior slider bracket via the pair of guide pins by at least two set screws extended therethrough at least two set screw receiving holes on an edge of the top side of the exterior slider guide block.

8. The assembly of claim 1, wherein the exterior slider guide block is secured to the interior slider bracket housed therebetween the longitudinal channel via at least two screws extended therethrough the at least two fastening screw receiving holes on the top side of the exterior slider guide block and the top side of the interior slider bracket.

9. The assembly of claim 1, further comprising at least one rubber pad disposed between the defined inner surface of the rear housing plate and the roller bearing component.

10. The assembly of claim 1, wherein the defined surface on the inner side of the front housing plate is semi-circular such that the first side of the roller bearing component is configured to be secured thereto with at least one rubber pad disposed therebetween.

11. The assembly of claim 1 further comprising at least one circular shaft component having an opening therethrough such that the front housing plate is secured to the bottom edge of the shower door via at least one bolt extended through the center opening of the rear housing plate, the opening of the at least one circular shaft component, and the center opening of the roller bearing component in the assembled configuration.

12. The assembly of claim 11, wherein the opening of the at least one circular shaft component is an eccentric hole configured to allow for vertical adjustment of the roller bearing component.

13. The assembly of claim 1, wherein the rear housing plate is secured to the bottom edge of the shower door via at least three bolts extended through the at least two receiving holes of the rear housing plate.

14. The assembly of claim 1, wherein the cover plate is secured to the rear housing plate via at least two bolts extended through the at least two receiving holes of the cover plate.

15. The assembly of claim 1, wherein the defined inner surface of the rear housing plate is semi-circular such that the second side of the roller bearing component is configured to be secured thereto with at least one rubber pad disposed therebetween.

16. The assembly of claim 1, wherein the roller bearing component is circular.

17. A guide and rail system for stabilizing a shower door and stationary panel of a shower enclosure, the system comprising:

a guide and rail assembly comprising:

an exterior slider bracket having a body configured for mounting on a top edge of the stationary panel, the exterior slider bracket having an inner side defining at least two holes for receiving a pair of guide pins therethrough;

an exterior slider guide block having a body defining a longitudinal channel therethrough and configured for mounting on a top edge of the shower door, the exterior slider guide block defining at least two fastening screw receiving holes on a top side thereof and at least two holes on a front side for receiving a distal end of the pair of guide pins therethrough;

an interior slider bracket having a body configured for mounting on the top edge of the shower door, the interior slider bracket defining at least two fastening screw receiving holes on a top side thereof, wherein the interior slider bracket is configured to be housed within the longitudinal channel of the exterior slider guide block such that the exterior slider guide block sets atop the interior slider bracket and is secured thereto, wherein the distal end of the pair of guide pins abut a front side of the interior slider bracket when extended therethrough the front side of the exterior slider guide block in an assembled configuration;

a front housing plate having an inner side and configured for attaching to a bottom edge of the shower door;

a roller bearing component having a first side and a second side and a center opening therethrough and configured to be slidably disposed along a top surface of a bottom guard rail of the shower enclosure, wherein the inner side of the front housing plate is configured to receive the first side of the roller bearing component in a defined surface on the inner side of the front housing plate;

a rear housing plate having a body defining a center opening therethrough and at least two receiving holes therethrough and configured for attaching to the bottom edge of the shower door, the rear housing plate having a defined inner surface configured to receive the second side of the roller bearing component;

a cover plate having a body defining at least two receiving holes therethrough, wherein an inner surface of the cover plate is configured to be secured to the rear housing plate;

wherein the cover plate and the rear housing plate are positioned on an opposite side of the bottom edge of the shower door from the front housing plate such that the roller bearing component is slidably disposed therebetween the front housing plate and the rear housing plate when in the assembled configuration, and wherein the exterior slider bracket, the exterior slider guide block, and the interior slider bracket are configured to be installed on the top edge of the stationary panel and the top edge of the shower door, and the front housing plate, the roller bearing component, rear housing plate, and cover plate are configured to be installed on the bottom edge of the shower door in a first area and a second area.

18. The system of claim 17, wherein the first area is on a left side of the shower door and the second area is on a right side of the shower door.

19. The system of claim 17, wherein the bottom guard rail of the shower enclosure includes a longitudinal track configured to be pre-drilled to allow moisture to flow therefrom and air to circulate within the guard rail.

* * * * *